US011673635B2

(12) United States Patent
Bertin

(10) Patent No.: US 11,673,635 B2
(45) Date of Patent: Jun. 13, 2023

(54) METHOD AND SYSTEM FOR NEUTRALIZING UNDERWATER EXPLOSIVE DEVICES

(71) Applicant: CALZONI S.R.L., Calderara di Reno (IT)

(72) Inventor: Daniele Maria Bertin, Milan (IT)

(73) Assignee: CALZONI S.R.L., Calderara di Reno (IT)

( * ) Notice: Subject to any disclaimer, the term of this patent is extended or adjusted under 35 U.S.C. 154(b) by 172 days.

(21) Appl. No.: 16/768,811

(22) PCT Filed: Dec. 13, 2018

(86) PCT No.: PCT/IB2018/060024
§ 371 (c)(1),
(2) Date: Jun. 1, 2020

(87) PCT Pub. No.: WO2019/116307
PCT Pub. Date: Jun. 20, 2019

(65) Prior Publication Data

US 2021/0122449 A1 Apr. 29, 2021

(30) Foreign Application Priority Data

Dec. 15, 2017 (IT) ..... 102017000145104

(51) Int. Cl.
*B63G 7/08* (2006.01)
*B63G 7/00* (2006.01)
*B63G 8/00* (2006.01)

(52) U.S. Cl.
CPC ..... *B63G 7/08* (2013.01); *B63G 2007/005* (2013.01); *B63G 2008/007* (2013.01)

(58) Field of Classification Search
CPC ..... B63G 7/00; B63G 2007/005; B63G 7/02; B63G 7/04; B63G 7/06; B63G 2007/065; B63G 7/08
See application file for complete search history.

(56) References Cited

U.S. PATENT DOCUMENTS 4,185,326 A 1/1980 Whittaker
5,844,159 A 12/1998 Posseme et al.
(Continued)

FOREIGN PATENT DOCUMENTS

DE 4323904 A1 1/1995
FR 2684951 A1 6/1993
(Continued)

OTHER PUBLICATIONS

International Search Report dated Mar. 11, 2019 from counterpart PCT App No. PCT/IB2018/060024.

*Primary Examiner* — Andrew Polay
(74) *Attorney, Agent, or Firm* — Shuttleworth & Ingersoll, PLC; Timothy Klima

(57) ABSTRACT

Described is a system for neutralising underwater explosive devices including an apparatus for identifying a naval mine, a source for emitting an acoustic signal for signalling the position of the naval mine, a first underwater vehicle designed to place the source for emitting an acoustic signal close to the naval mine, a measurement apparatus designed to determine a first distance between the source of emission of an acoustic signal and the naval mine.

13 Claims, 2 Drawing Sheets

(56) References Cited

U.S. PATENT DOCUMENTS

| | | | | |
|---|---|---|---|---|
| 2008/0087186 | A1* | 4/2008 | Blohm | F41H 11/16<br>102/403 |
| 2015/0049588 | A1* | 2/2015 | Lambertus | B63G 8/001<br>114/144 R |
| 2015/0225049 | A1* | 8/2015 | Fairfield | B63G 8/28<br>89/1.13 |
| 2018/0224568 | A1* | 8/2018 | Brizard | G01V 1/3835 |

FOREIGN PATENT DOCUMENTS

| | | | | |
|---|---|---|---|---|
| JP | 4486211 | B2 | 7/2011 | |
| JP | 2011143907 | A | 7/2011 | |
| KR | 20080085509 | A * | 10/2008 | B63G 8/39 |

* cited by examiner

METHOD AND SYSTEM FOR NEUTRALIZING UNDERWATER EXPLOSIVE DEVICES

This invention relates to a method for neutralising underwater explosive devices.

This invention also relates to a system for neutralising underwater explosive devices.

More specifically, this invention relates to the technical field of underwater operations, such as, for example, the removal of naval mines from a specific area of the sea.

In military operations at sea, in effect, the naval mines are often used to achieve important advantages over the enemy. These mines may remain hidden under the surface of the sea for years, waiting for a ship to active their detonation sensors even a very long time after the resolution of the conflict.

The removal of underwater explosive devices, such as the above-mentioned naval mines, is therefore of vital importance for the safety of maritime routes, even civil ones.

In the prior art current, the methods for neutralising underwater explosive devices, without the intervention of specific underwater personnel, often comprise two steps, a so-called search and localisation step and a so-called identification and neutralisation step.

The first search and localisation step often comprises, in the prior art, the determination of the spatial position of an underwater object and a first classification thereof to determine the possibility of whether it is an explosive device, and it is carried out with the use of sensors such as, for example, acoustic or sonar sensors, used for inspecting large stretches of the sea.

The second identification and neutralisation step usually comprises, for the known neutralisation methods (such as the known mine hunting methods), a visual inspection of the underwater explosive device localised in the first step, for example by video camera, for determining with reasonable certainty that it is an explosive device, and a subsequent putting out of use or neutralisation. In order to perform this step, use is made in the prior art of cable-guided underwater vehicles, so-called ROV (Remotely Operated Vehicles), manoeuvred by an operator who is on board a naval unit.

These ROVs also transport, in the known methods, explosive charges of significant size which are positioned close to the underwater explosive devices identified as dangerous. In the above-mentioned mine hunting methods, this latter operation is called neutralisation by counter-mining.

In the above-mentioned known methods the ROVs are usually integral with the explosive charge, so as to allow more contained dimensions of the explosive charge, which transport and explode together with it at a distance close to or in contact with the mine.

Alternatively, there are more recent neutralising methods in which the ROVs fix the above-mentioned explosive charge to the underwater explosive device, for example using a nail gun device.

Moreover, for the methods in which the ROVs are not integral with the explosive charge, the prior art also provides for configuring the ROVs for transporting several explosive charges. In these prior art methods it is therefore possible to use the same ROV for neutralising several underwater explosive devices classified as dangerous.

The above-mentioned methods and systems for neutralising known underwater explosive devices, with regard to the military doctrine, are not free from drawbacks.

A first drawback relates to the high operating costs of the prior art methods, deriving in particular from the destruction of the above-mentioned ROV.

More specifically, if the ROV is integral with the explosive charge, its destruction is necessary for the purpose of the identification and neutralisation step.

Alternatively, if the ROV fixes the explosive charge to the underwater explosive device, the manoeuvres performed by the ROV close to the underwater explosive device identified as dangerous can trigger explosive reactions in it or explode the explosive charge, causing destruction of the ROV.

A second drawback relates to the times necessary for ROV to be reconfigured between one use and the next, in particular if the ROV has not placed the explosive charge (for example, if the explosive device identified has not then been classified as dangerous).

A further drawback relates to the size of the ROV. The ROV, depending on the operating mode, must in effect be able to transport one or more explosive charges, often with significant dimensions and weights.

The aim of this invention is to overcome the above-mentioned drawbacks of the prior art.

More specifically, the aim of this invention is to provide a method and a system for neutralising underwater explosive devices whose costs for use are reduced compared with the prior art.

The aim of the invention is also to provide a method and a system for neutralising underwater explosive devices which allows a reduction in the time of use and the size of the means used, for example the ROVs.

The technical features of the invention according to the above-mentioned objects may be easily inferred from the present disclosure.

The advantages of the invention will become more apparent from the detailed description which follows, with reference to the accompanying drawings which illustrate preferred embodiments of the invention provided merely by way of example without restricting the scope of the inventive concept, and in which.

Figure 1:
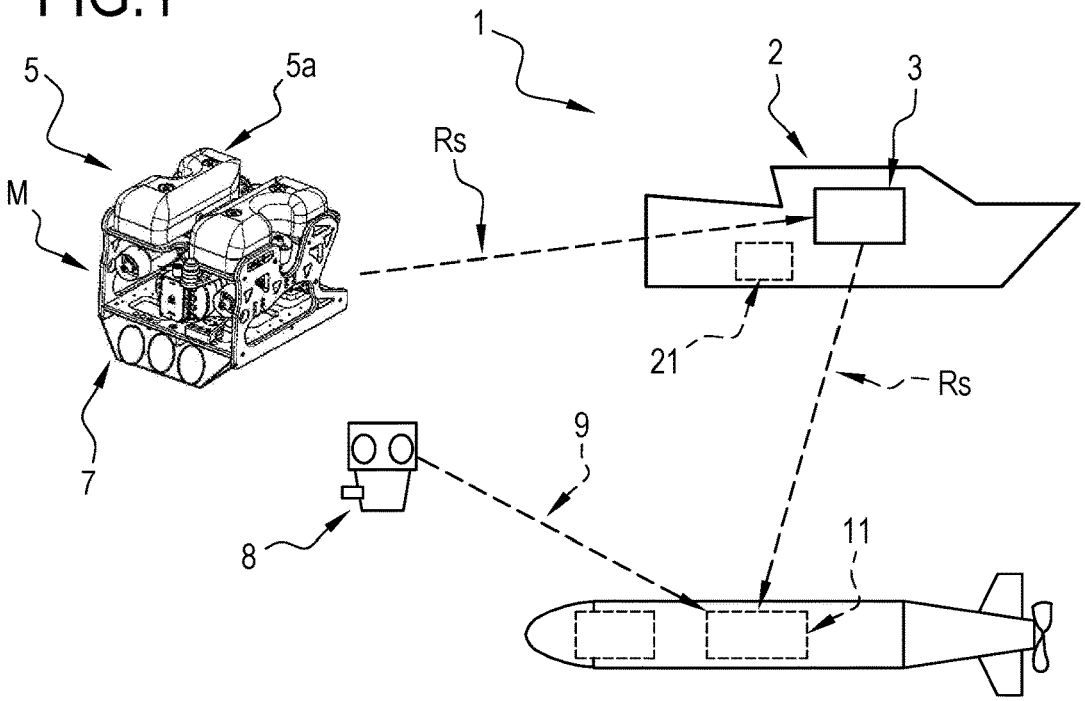
FIG. 1 is a schematic view of a first embodiment of the system for neutralising underwater explosive devices according to this invention.
Figure 2:
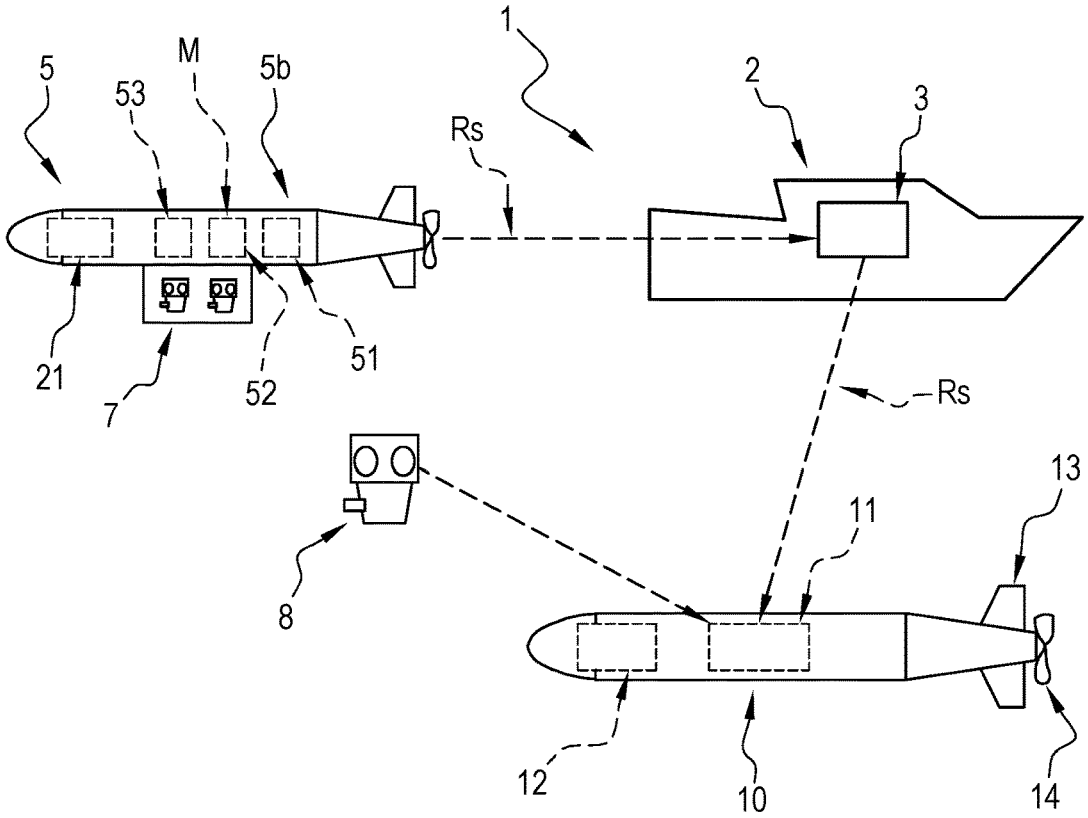
FIG. 2 is a schematic view of a second embodiment of the system for neutralising underwater explosive devices according to this invention.

As illustrated in the FIGS. 1 and 2, the numeral 1 denotes in its entirety the system for neutralising underwater explosive devices according to this invention.

The neutralising system 1 comprises a boat 2.

The boat 2 comprises a remote control station 3 designed to monitor the operation of the system 1.

Figure 3:
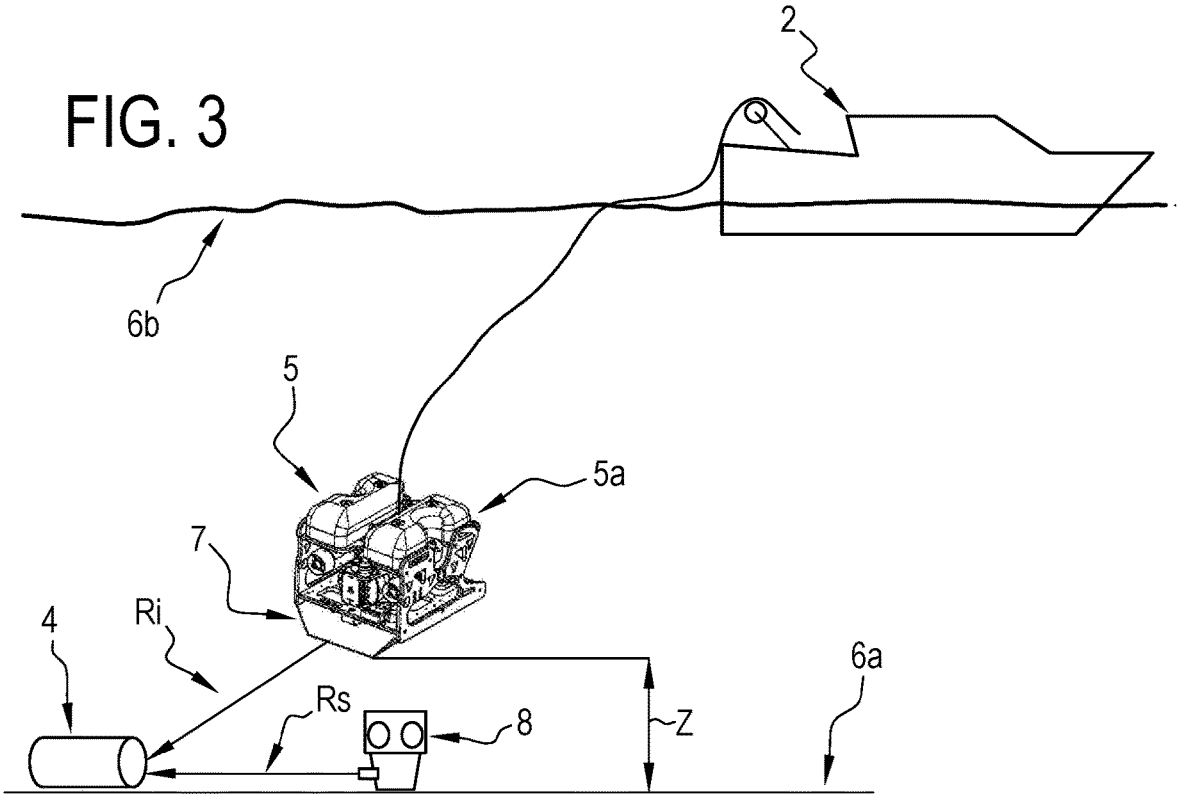
FIGS. 3 and 4 show, in respective schematic views, the system of the previous drawings, in two different operating steps.
Figure 4:
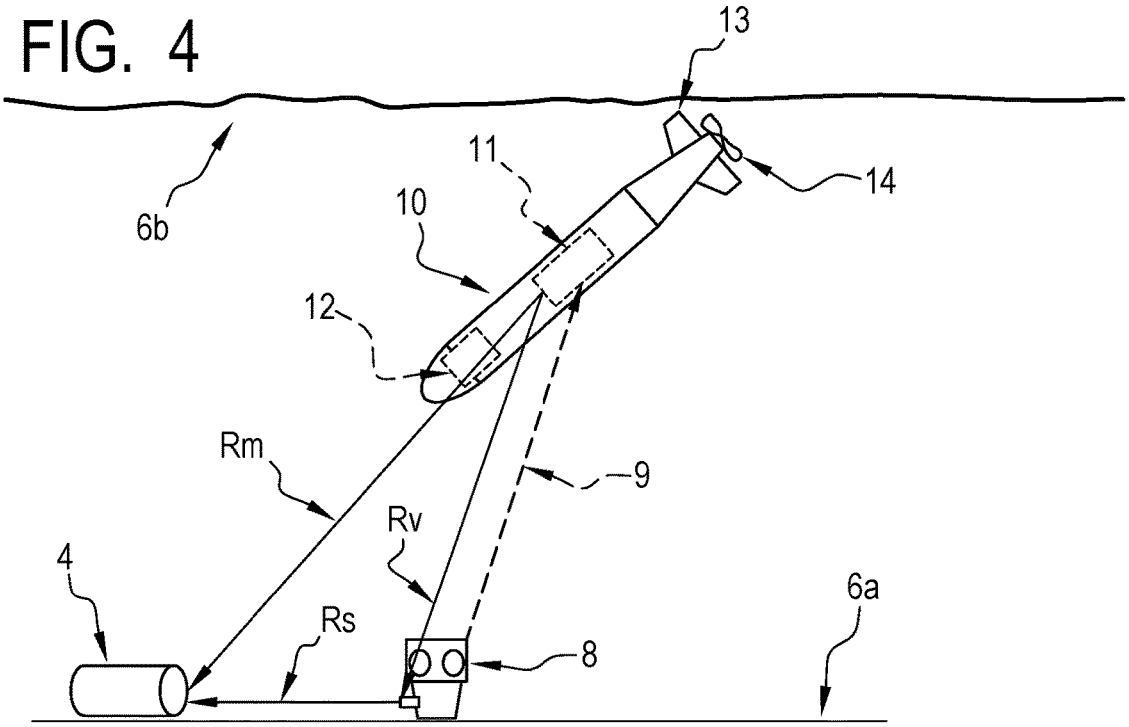

FIGS. 3 and 4 schematically show a marine environment and the reference numerals 6*a*, 6*b* denote, respectively, a sea bed and a respective water surface.

With reference to FIG. 1, the boat 2 also comprises an exploratory sensor 21 designed to locate underwater objects, in particular the naval mine 4 illustrated in FIGS. 3 and 4 and situated close to the boat 2.

The exploratory sensor 21 comprises, by way of example, in the operational use, search sonar and, possibly, side-scan sonar also in the synthetic aperture side-scan version (SAS).

For the purposes of this description, the above-mentioned naval mine 4 defines an underwater explosive device.

The underwater explosive device is in effect an underwater element designed to detonate under certain conditions, for example upon the passage of a boat in the area of sea adjacent to the explosive device.

In the embodiment of this invention illustrated in FIG. 2, the localisation of the underwater explosive devices is advantageously performed using the above-mentioned exploratory sensor 21 supported by a specially configured underwater vehicle.

Equally advantageously, it is possible to support the above-mentioned exploratory sensor 21 by means of a vehicle operating above the water surface 6*b*, for example by an aircraft (such as a helicopter) or by a second boat, not illustrated, which may have an autonomous propulsive system or be transported.

Advantageously, this second boat is transported by the above-mentioned boat 2.

The above-mentioned exploratory sensor 21 defines, for the neutralising system 1, a sensor for localising the naval mine 4.

The cable-guided underwater vehicle 5*a* is advantageously a vehicle of the ROV type, in accordance with the current military uses.

As illustrated in FIG. 2, in the above-mentioned second embodiment the neutralising system 1 comprises, on the other hand, a self-guided underwater vehicle 5*b*.

The self-guided underwater vehicle 5*b* is advantageously a so-called AUV vehicle (Autonomous Underwater Vehicle), usually used to perform search and localisation operations of underwater contacts in large stretches of the sea, in accordance with the current military use. A vehicle of this type is usually set up to navigate autonomously below the water surface 6*b* and record information on the configuration of the sea bed 6*a*. This information is transmitted, for example, by receivers out of the water by radio transmission during emersion of the vehicle.

Advantageously, in the embodiment of FIG. 2, the self-guided underwater vehicle 5*b* also comprises the above-mentioned exploratory sensor 21 designed to locate the naval mine 4.

The cable-guided underwater vehicle 5*a* and the self-guided underwater vehicle 5*b* define, for the neutralising system 1, respective embodiments of a first underwater vehicle 5.

The first underwater vehicle 5 comprises a laser measurement device, illustrated schematically only in FIG. 2 with a block 51, designed to measure a first distance Ri between the above-mentioned naval mine 4 and the first underwater vehicle 5 by means of one or more laser beams if necessary combined with video cameras (or equivalent optical sensors) and comprising the so-called laser scanners.

The above-mentioned laser measurement device 51 defines for the neutralising system 1 a sensor designed for measuring spatial data relating to the naval mine 4.

According to alternative embodiments, not illustrated, of this invention, as an alternative to the laser measurement device 51, an acoustic measurement device or a sonar are installed on board the first underwater vehicle 5.

The first underwater vehicle 5 comprises an inertial reference unit, illustrated schematically in FIG. 2 with a block 52, designed to measure the spatial arrangement in space of the first underwater vehicle 5.

The first underwater vehicle 5 also comprises an echometer instrument, illustrated schematically only in FIG. 2 with a block 53, designed to measure a vertical distance Z of the first underwater vehicle 5 from the sea bed 6*a*, as illustrated in FIG. 3.

Advantageously, the echometer instrument 53 is a depth sounding device.

The above-mentioned inertial reference unit 52 and echometer instrument 53 constitute sensors designed for measuring proprioceptive spatial data.

As illustrated in the accompanying drawings, the neutralising system 1 comprises a source 8 for emitting an acoustic signal 9 designed to be positioned close to the naval mine 4.

With reference to FIGS. 1 and 2, the first underwater vehicle 5 comprises a storage system 7 for containing the above-mentioned sources 8 and is designed to transport the sources 8 close to the naval mine 4.

Advantageously, the source 8 of emission is designed to transmit the acoustic signal 9 under the surface 6*b* of the water and to indicate by the same acoustic signal 9 the position of the naval mine 4.

Advantageously, according to preferred embodiments, the emission source 8 comprises an acoustic transponder or, alternatively, an acoustic signalling device.

The source emits the acoustic signal 9 periodically or, alternatively, upon a further acoustic signal, not illustrated, emitted by a measurement apparatus M supported by the above-mentioned first underwater vehicle 5.

The first underwater vehicle 5 comprises releasing means, not illustrated, designed to pick up from the storage system 7 the above-mentioned source 8 for emitting the acoustic signal 9, physically separate and physically disconnect the emitting source 8 from the first underwater vehicle 5, and place it close to the naval mine 4.

Advantageously, but not necessarily, the release means, not illustrated, are designed to place the source 8 for emitting the acoustic signal 9 by gravity.

As illustrated in FIGS. 1 and 2, the storage system 7 is advantageously positioned in the lower part of the first underwater vehicle 5, to facilitate the placing by gravity of the above-mentioned source 8 by the above-mentioned and not illustrated release means.

The above-mentioned laser measurement device 51, inertial reference unit 52 and echometer instrument 53 define, in their entirety for the neutralising system 1, the above-mentioned apparatus M for measuring a first distance Rs between the above-mentioned source 8 for emitting the acoustic signal 9 and the naval mine 4.

The distance Rs is a vector distance.

As illustrated in FIG. 1, the measurement apparatus M, in the first embodiment of the neutralising system 1, is connected via cable to the above mentioned remote control station 3, for transmitting the above-mentioned first distance Rs to the remote control station 3.

Advantageously, this connection via cable is accomplished by the same cable for controlling the cable-guided underwater vehicle 5*a*, as illustrated for example in FIG. 3.

With reference on the other hand to variant embodiment illustrated in FIG. 2, the measurement apparatus M is advantageously connected to the remote control station 3 by means of a wireless connection, of known type and not described further, for example with contacts which are not continuous and constant over time.

The first underwater vehicle 5 also comprises a video camera (or equivalent optical sensor) and/or a sonar (or equivalent acoustic sensor), not illustrated, for identifying the naval mine 4, for example by means of recording high resolution images.

The video camera and/or sonar are advantageously designed to operate below the above-mentioned water surface 6*b* and define a sensor for identifying the naval mine 4.

More specifically, the above-mentioned sonar is advantageously designed to operate in specific water conditions, such as turbid water.

The above-mentioned and not illustrated video camera and/or sonar and the exploratory sensor 21 define in their entirety, for the neutralising system 1, an apparatus for identifying the naval mine 4.

As illustrated in FIGS. 1, 2 and 4, the neutralising system 1 comprises a second underwater vehicle 10.

The second underwater vehicle 10 is a self-guided underwater vehicle and comprises a command and control unit 11.

The second underwater vehicle 10 also comprises an explosive charge 12, advantageously located in the front part of it and designed to detonate upon an impact between the second underwater vehicle 10 and the naval mine 4.

Alternatively, the explosive charge 12 may detonate close to the above-mentioned underwater explosive device 4 without the need for physical contact, according to known methods in the prior art without loss of functionality, for example, by means of a switch operated remotely or a proximity sensor.

The above-mentioned command and control unit 11 guides the second underwater vehicle 10 close to the naval mine 4 along a trajectory Rm determined as a function of the above-mentioned first distance Rs and the acoustic signal 9.

The command and control 11 comprises a receiver, of known type and not illustrated, for the acoustic signal 9 and is connected to the above-mentioned remote control station 3 by a further receiver, configured for radio or acoustic signals, also not illustrated, for the first distance Rs.

Alternatively, the connection between the control unit 11 on the second vehicle 10 and the remote control station 3 on the surface is performed by means of a temporary connection cable or an electronic storage device (such as a USB), both not illustrated. Alternatively, the connection is achieved by wireless connection.

In other words, the first distance Rs as determined by the above-mentioned measurement apparatus M is transmitted from the measurement apparatus M to the remote control station 3.

The remote control station 3 transmits the identification signal of the first distance Rs to the above-mentioned control and control unit 11 for determining the trajectory Rm of the second underwater vehicle 10.

The command and control unit 11 is operatively connected to the above-mentioned measurement apparatus M for receiving a signal identifying the first distance Rs.

As illustrated in FIGS. 1 and 2, the second underwater vehicle 10 also comprises two hydrodynamic surfaces 13 and a propeller propulsion system 14 for moving the second underwater vehicle 10 in the water.

Advantageously, the hydrodynamic surfaces 13 and the propeller propulsion system 14 are located in the rear part of the second underwater vehicle 10, in order to improve the propulsive thrust designed to move the second underwater vehicle 10.

Described below are the functional aspects of the system 1 for neutralising underwater explosive devices described above, in accordance with a preferred use of the invention.

The method for neutralising underwater explosive devices according to this invention comprises a first step of locating a naval mine 4 positioned on the sea bed 6*a*.

Advantageously, the step of locating the mine 4 is actuated by the above-mentioned exploratory sensor 21.

The exploratory sensor 21 is advantageously supported in the embodiment of FIG. 2 by the self-guided underwater vehicle 5*b* and in the embodiment of FIG. 1 by the boat 2.

After locating the naval mine 4, the above-mentioned source 8 of emission of the acoustic signal 9 is prepared.

Alternatively, the source 8 of emission is set up prior to the above-mentioned localisation without loss of functionality.

In other words, one or more sources 8 of emission are specially configured according to the prior art (for example, according to the type of source used) and conveyed inside the storage system 7 of the first underwater vehicle 5, for example in specific housings prepared inside the storage system 7.

As illustrated in FIG. 3, the first cable-guided underwater vehicle 5*a* is guided inside the marine environment close to the naval mine 4 located previously, for placing the source 8 in such a way as to signal through the acoustic signal 9 the position of the naval mine 4.

Advantageously, the source 8 is placed on the sea bed 6*a* to define the reference for the subsequent calculation of the above-mentioned first distance Rs between the source 8 and the naval mine 4.

During the above-mentioned step of placing the source 8, the step is advantageously actuated of identifying the naval mine 4 by means of the above-mentioned video camera and/or sonar (or in any case by an identification sensor capable of operating below the water surface), situated on board the first cable-guided underwater vehicle 5*a*.

By way of example, an operator who controls the cable-guided underwater vehicle 5*a* (ROV) determines by means of the video camera and/or by means of the sonar the most suitable point for release of the source 8.

The term "suitable point" means the position in space in which a counter-mining charge is most effective for the destruction of the naval mine 4, for example determined with the aid of a laser tracer associated with the measurement apparatus M to help display this point on the surface of the mine 4 itself.

In other words, the cable-guided underwater vehicle 5*a* is lowered into the sea from the boat 2 and guided by an operator (advantageously by the remote control station 3) close to the naval mine 4 previously located.

If the naval mine 4 is identified as dangerous, a source 8 for emitting an acoustic signal 9 is placed close to the naval mine 4.

Alternatively, in a manner not illustrated but in any case falling within the scope of the inventive concept, it is possible to use a self-guided underwater vehicle 5*b* wherein the control function is not performed by the human operator but automatically by a suitable algorithm executed on a computer suitably configured for performing the above-mentioned identification phase.

Advantageously, in the case of the above-mentioned moored mines, that is to say, those mines which are anchored to the sea bed with suitable ballasts and suspended from them by means of chains, devices are provided, not illustrated, for attaching the source 8 to the chain itself.

Moreover, an alternative, so-called mixed, embodiment, not illustrated, is possible in which the self-guided underwater vehicle 5*b* places the source 9 and the identification of the naval mine 4 is performed at a later time, for example by the human operator.

Advantageously, the computer is on board the self-guided underwater vehicle 5*b* or integrated in the remote control station 3.

The above-mentioned steps of identifying and locating the naval mine 4 define together the step of identifying the underwater explosive device 4.

As shown in FIG. 3, upon the placing of the emission source 8 of the above-mentioned acoustic signal 9, the step of determining the above-mentioned first distance Rs between the source 8 on the sea bed 6*a* and the naval mine 4 is performed.

Advantageously, the step of determining the first distance Rs is actuated by the above-mentioned measurement apparatus M.

Moreover, in order to correctly determine the distance Rs in space, the above-mentioned proprioceptive sensors 52, 53 are used, located on board the first underwater vehicle 5.

More specifically, in order to determine the spatial arrangement of the first underwater vehicle 5 the above-mentioned inertial reference unit 52 is advantageously used.

In the same way, use is made of the above-mentioned depth sounding device 53 to determine the vertical distance Z between the sea bed 6*a* and the first underwater vehicle 5.

In other words, the measurement apparatus M determines a distance Ri between the first underwater vehicle 5 and the naval mine 4.

Subsequently, the distance Ri is converted by the measurement apparatus M into the above-mentioned first distance Rs by means of orthogonal projection on the plane determined by the vertical distance Z.

Alternatively, the distance Ri is converted into the first distance Rs in the remote control station 3 or in the above-mentioned command and control unit 11 on board the above-mentioned second underwater vehicle 10.

In the embodiment of FIG. 2, the transmission of the data Rs (or Ri) to the remote control station 3 is performed preferably upon the availability of a wireless connection, for example during the emersion of the self-guided underwater vehicle 5*b*.

Subsequently, the second underwater vehicle 10, advantageously self-guided, is prepared for conveying the above-mentioned explosive charge 12 close to the naval mine 4 along the trajectory (Rm), as illustrated in FIG. 4.

The trajectory Rm is determined by the vector sum between the above-mentioned first distance Rs and a second distance Rv, as follows:

$$Rm=Rs+Rv$$

More specifically, the second distance Rv is calculated using the flight time of the above-mentioned acoustic signal 9 between the source 8 which emits it and the command and control unit 11 which receives it.

The flight time is calculated according to known methods in the prior art and therefore not described further.

As an alternative to the flight time, the second distance Rv is calculated by measuring the angle of reception of the signal emitted by the source 8 and measured by two sensors, not illustrated, positioned suitably spaced on the second vehicle 10.

For the purposes of calculating the vector sum, both the first distance Rs and the above-mentioned second distance Rv may be considered as vectors in the three-dimensional space of the marine environment.

By way of example, the trajectory Rm is a vector designed so that the naval mine 4 reaches the second underwater vehicle 10 in the least possible time.

Alternatively, the trajectory (Rm) comprises an initial step of alignment along a trajectory determined from the second distance Rv between the source 8 and the mine 4 and then a step of alignment along the trajectory (Rm) in such a way as to strike the mine at the predetermined point from an direction advantageous.

The method according to this invention also comprises a step of detonating the above-mentioned explosive charge 12 upon reaching the naval mine 4.

More specifically, the expression "reaching the naval mine 4" means the reaching, between the explosive charge 12 and the naval mine 4, of a distance such that the detonation of the explosive charge 12 results in the neutralisation (usually destruction) of the naval mine 4.

More specifically, the explosive charge 12 advantageously detonates on impact with the naval mine 4.

The second underwater vehicle 10 is also advantageously free of expensive apparatuses such as sonar, etc., so that it can be made integral with the explosive charge 12.

More specifically, the explosive charge 12 may also detonate upon an impact between the second underwater vehicle 10 and the underwater explosive device 4.

Alternatively, the explosive charge may detonate at a signal sent by an optical fibre, advantageously used for manoeuvring the second underwater vehicle 10.

According to an alternative embodiment of the invention, not illustrated in detail, the source 8 is configured for receiving directly from the apparatus M the value of the first distance Rs and transmitting the value of Rs directly to the command and control unit 11 positioned on the second vehicle 10.

The embodiment just described advantageously avoids the triangulation of information with the above-mentioned remote control station 3 which is normally designed to receive the first distance Rs from the measurement apparatus M and subsequently transmit to the command and control unit 11 positioned on the second vehicle 10.

The system and the method described above in accordance with this invention achieve the preset aims and allow the achievement of important advantages.

A first advantage connected to this invention is given by the reduction in costs due to the destruction of the cable-guided underwater vehicles (ROV) or, alternatively, the self-guided underwater vehicles (AUV), in the step for identifying and neutralising the underwater explosive devices.

In effect, according to this invention, neither of the two alternative embodiments of the first underwater vehicle explodes integrally with the explosive charge.

This risk is further reduced since the first vehicle does not need to get excessively close to fix or keep in contact an explosive charge with the mine, as in the prior art.

It is also worth noting, in this regard, that unlike the second underwater vehicle the first underwater vehicle comprises much more complex and expensive apparatuses and sensors.

One need only consider the acoustic and proprioceptive sensors mentioned above in the description.

Another advantage is given by the reduction in the dimensions of the first underwater vehicle.

More specifically, the transmission sources have contained dimensions and weights relative to the explosive charges and this allows the preparation of cable-guided or self-guided underwater vehicles, designed to transport them, with reduced dimensions compared with the prior art.

This results in a further advantage with the reduction in the dimensions of the support boat as a smaller space is necessary for containing the underwater vehicles mentioned above during transport to the place of operation.

A further advantage guaranteed by this invention is the simplicity of release of the sources of emission by the first underwater vehicle, irrespective of the embodiment, in particular by means of a simple release (by gravity).

Another advantage resulting from this invention is the avoidance of the risk of an explosion during the search and localisation step and during the identifying of the underwater explosive device.

In effect, if underwater explosive device located is not identified as dangerous, it is not necessary to prepare the explosive charge and the second underwater vehicle (preferably self-guided) designed to transport it, thereby reducing the risk of accidental explosions due to the handling of the charge itself.

Lastly, yet another advantage can be identified in the possibility of using the first underwater vehicle for more time (for example, for several continuous operations), irrespective of the embodiment.

In effect, a first underwater vehicle according to this invention may place several sources at several underwater explosive devices and only subsequently are the explosive charges sent to neutralise them, using a second underwater vehicle (or more than one).

The invention claimed is:

1. A neutralization method for neutralizing underwater explosive devices, comprising the steps of:

identifying an underwater explosive device, preparing an emitting source for emitting an acoustic signal, using a first underwater vehicle configured to transport the emitting source toward the underwater explosive device to a determined approach position, and after reaching the determined approach position, physically separating and physically disconnecting the emitting source from the first underwater vehicle, and vertically placing the separated emitting source below the first underwater vehicle on a seabed within a location distance to the underwater explosive device sufficient to provide a location of the underwater explosive device via the acoustic signal, measuring a distance (Ri) between the first underwater vehicle and the underwater explosive device and a height (Z) of the first underwater vehicle from the seabed;

determining geometrically a first distance (Rs) between the emitting source and the underwater explosive device as a projection of the distance (Ri) on a horizontal line separated by the height (Z) from an end of the distance (Ri), preparing an explosive charge to be carried by a second underwater vehicle, calculating, using the acoustic signal, a second distance (Rv) correlated with the distance between the second underwater vehicle and the emitting source, determining a trajectory to be travelled by the second underwater vehicle to carry the explosive charge to reach the underwater explosive device using the acoustic signal, the step of determining the trajectory comprising a step of calculating a vector sum of the first distance (Rs) and the second distance (Rv);

moving the second underwater vehicle physically separate and physically disconnected from the emitter source along the trajectory to guide the explosive charge to within a neutralization distance of the underwater explosive device sufficient to neutralize the underwater explosive device, detonating the explosive charge when the explosive charge is within the neutralization distance.

2. The neutralization method according to claim 1, and further comprising a step of determining a flight time of the acoustic signal emitted by the emitting source for reaching the second underwater vehicle, wherein the second underwater vehicle is configured for receiving the acoustic signal and the second distance is determined via the flight time.

3. The neutralization method according to claim 1, and further comprising performing the step of determining the first distance with a sensor configured for measuring proprioceptive spatial data and spatial data relating to the underwater explosive device, the sensor being supported by the first underwater vehicle.

4. The neutralization method according to claim 1, and further comprising performing the step of detonating the explosive charge by impacting the explosive charge with the underwater explosive device.

5. A system for neutralizing underwater explosive devices, comprising:

an identifying apparatus for identifying an underwater explosive device, an emitting source for emitting an acoustic signal for signaling a position of the underwater explosive device, a first underwater vehicle configured to transport the emitting source toward the underwater explosive device to a determined approach position, and after reaching the determined approach position, physically separate and physically disconnect the emitting source from the first underwater vehicle, and vertically place the separated emitting source below the first underwater vehicle on a seabed within a location distance to the underwater explosive device sufficient to provide a location of the underwater explosive device via the acoustic signal, a first measurement apparatus configured for measuring a distance (Ri) between the first underwater vehicle and the underwater explosive device and a height (Z) of the first underwater vehicle from the seabed;

a second measurement apparatus configured for geometrically determining a first distance (Rs) between the emitting source and the underwater explosive device as a projection of the distance (Ri) on a horizontal line separated by the height (Z) from an end of the distance (Ri), an explosive charge configured to detonate within a neutralization distance of the underwater explosive device sufficient to neutralize the underwater explosive device, a second underwater vehicle configured to transport the explosive charge, a command and control unit configured to:

calculate, using the acoustic signal, a second distance (Rv) correlated with the distance between the second underwater vehicle and the emitting source, and determine a trajectory to be travelled by the second underwater vehicle to reach the underwater explosive device as a function of the acoustic signal and a vector sum of the of the first distance (Rs) and the second distance (Rv), and to guide the second underwater vehicle physically separate and physically disconnected from the emitter source along the trajectory to move the explosive charge to within the neutralization distance of the underwater explosive device, the command and control unit comprising a receiver for the acoustic signal and being operatively connected to the second measurement apparatus;

the explosive charge configured to be detonated when the explosive charge is within the neutralization distance.

6. The neutralizing system according to claim 5, wherein the identifying apparatus comprises a sensor for localizing the underwater explosive device and a sensor for identifying the underwater explosive device.

7. The neutralizing system according to claim 5, wherein the first underwater vehicle comprises a storage system configured for 1) storing and transporting the emitting source prior to placing the emitting source, and 2) releasing the emitting source away from the first underwater vehicle to place the emitting source.

8. The neutralizing system according to claim 5, wherein the first underwater vehicle is one chosen between a cable-guided underwater vehicle and a self-guided underwater vehicle.

9. The neutralizing system according to claim 5, wherein the first underwater vehicle comprises the second measurement apparatus.

10. The neutralizing system according to claim 5, wherein the second underwater vehicle is a self-guided underwater vehicle and comprises the command and control unit.

11. The neutralizing system according to claim 5, wherein the second underwater vehicle comprises hydrodynamic surfaces and a propulsion unit configured for moving the second underwater vehicle in the water.

12. The neutralizing system according to claim 5, and further comprising a remote control station configured to monitor operation of the system, the remote control station comprising a receiving device for receiving the first distance transmitted from the second measurement apparatus and a transmitting device for transmitting the first distance to the command and control unit.

13. The neutralizing system according to claim 5, wherein the emitting source is configured for receiving directly from the second measurement apparatus a value of the first distance and transmitting the value to the command and control unit.

* * * * *